US006874200B2

(12) United States Patent
Van Parys

(10) Patent No.: US 6,874,200 B2
(45) Date of Patent: Apr. 5, 2005

(54) HINGE AND HINGE PART THEREFOR

(76) Inventor: Remi Emiel Van Parys, Zultseweg 120, Waregem (BE), B-8790

( * ) Notice: Subject to any disclaimer, the term of this patent is extended or adjusted under 35 U.S.C. 154(b) by 0 days.

(21) Appl. No.: 10/316,902

(22) Filed: Dec. 12, 2002

(65) Prior Publication Data

US 2003/0115717 A1 Jun. 26, 2003

(30) Foreign Application Priority Data

Dec. 13, 2001 (BE) ..... 2001/0812

(51) Int. Cl.[7] ..... E05D 5/02
(52) U.S. Cl. ..... 16/252; 16/382
(58) Field of Search ..... 16/252, 382, 254, 16/264, 266; 411/427, 176, 160, 185–189; 403/408.1

(56) References Cited

U.S. PATENT DOCUMENTS

| | | | | |
|---|---|---|---|---|
| 3,013,297 A | | 12/1961 | Ferry | |
| 3,590,419 A | * | 7/1971 | Dargene | 16/235 |
| 3,908,330 A | * | 9/1975 | Frach et al. | 403/408.1 |
| 4,864,692 A | | 9/1989 | Prevot et al. | |
| 4,881,296 A | * | 11/1989 | Marinoni | 16/237 |
| 6,175,992 B1 | * | 1/2001 | Sauerland | 16/382 |

FOREIGN PATENT DOCUMENTS

| | | | | |
|---|---|---|---|---|
| DE | 2042348 B | * | 11/1976 | E05D/5/02 |
| DE | 29805950 U1 | * | 6/1998 | E05D/5/02 |
| DE | 10106218 C1 | * | 5/2002 | E05D/7/04 |
| EP | 504115 A1 | * | 9/1992 | E05D/5/02 |
| EP | 1 134 344 A2 | | 9/2001 | |
| GB | 1 486 013 | | 9/1977 | |
| GB | 2181483 A | * | 4/1987 | E05D/7/10 |
| JP | 08004460 A | * | 1/1996 | E06B/11/04 |
| WO | WO 200225046 A1 | * | 3/2002 | E05D/5/02 |

* cited by examiner

*Primary Examiner*—Chuck Y. Mah

(57) ABSTRACT

The invention concerns a hinge comprising two hinge parts (1,2) connected by a hinge pin (3), whereby the hinge pin (3) is provided with a stop (5) on one far end with which it will be situated against a hinge part (1). The other far end of the hinge pin (3) is fixed in relation to the other hinge part (2) by means of a somewhat springy bush (6) which catches in a groove (11) in said hinge pin (3) with at least one inwardly directed protrusion (9) on the one hand, and which is situated against an edge (2A) of the aforesaid other hinge part (2) with at least one outwardly directed protrusion (8,8A;9) on the other hand.

7 Claims, 3 Drawing Sheets

HINGE AND HINGE PART THEREFOR

BACKGROUND OF THE INVENTION

1. Field of the Invention

The present invention concerns a hinge of the type having two hinge parts and a hinge pin protruding through the two hinge parts.

2. Discussion of the Related Art

Such hinges are often used for metal doors and windows. The hinge parts are first attached to the fixed frame and, the leaf respectively, and only when the leaf is placed in the frame, the hinge parts are connected to one another by the hinge pin.

One far end of the hinge pin has a stop, for example a collar or a clamping ring. Near its other far end, the hinge pin is provided with a groove over its perimeter. After the hinge pin has been inserted until said stop is situated against a hinge part, the hinge pin is held tight by a screw in relation to the other hinge part in the known hinges, which screw is screwed through the latter hinge part into the above-mentioned groove.

This screwing in has to be done by the installer of the window or the door, and it is time-consuming for him. Moreover, it sometimes has to be done in bad conditions. The screws can get lost during transport due to vibrations, and a screwdriver is not always at hand.

SUMMARY OF THE INVENTION

The invention aims a hinge which does not represent these disadvantages and which can be composed in a simple and fast manner, without the use of any screws.

This aim is reached according to the invention by means of a hinge comprising two hinge parts connected by a hinge pin, whereby the hinge pin is provided with a stop at one far end with which it will be situated against a hinge part, and is fixed in relation to the other hinge part at the other far end, characterized in that the hinge pin is fixed in relation to said other hinge part by means of a somewhat springy bush which catches in a groove in said hinge pin with at least one inwardly directed protrusion on the one hand, and is situated against an aforesaid other hinge part with at least one outwardly directed protrusion on the other hand.

Thanks to the spring-mounted bush, the hinge pin can be fixed in the hinge parts very quickly without any screws needing to be tightened.

Preferably, the hinge pin has a far end with a smaller diameter there where it is surrounded by the bush, and the groove is provided in this far end.

Between the hinge pin and the wall of the opening in the hinge part, there must be sufficient space for the bush, so that it can spring while being provided. By narrowing the far end of the hinge pin, it is no longer required to enlarge the opening in the hinge part.

The bush can be provided with an interruption over its, entire height. In fact, the bush forms an interrupted ring of somewhat springy material, for example plastic.

The protrusions can form collars on the far ends of the bush.

On at least one of the far ends of the bush, the protrusion can be beveled, so that it decreases in height towards this far end, as a result of which it becomes easy to put the bush with this far end in an opening of the hinge parts or to provide it over a far end of the hinge pin.

Moreover, a protrusion beveled on the outside can be situated against the edge of the hinge part, and a nonbeveled protrusion can stick in the groove in the hinge pin, or vice versa, a non-beveled protrusion can stick in the groove in the hinge pin and a protrusion beveled on the inside can be situated against the edge of the hinge part.

Not only the fixing of the hinge pin by the installer, but also the clamping of the frame part on the molding of the frame of a door or window is time-consuming in the case of the known hinges with two hinge parts and a hinge pin, whereby the one hinge part, usually the frame part, has an L-shaped blade, a part of which is provided with the opening for the hinge pin, and the part standing crosswise upon it is fixed on the molding.

Traditionally, with the known hinges, this fixing is done by means of screws, screwed through the latter part in a tightening piece by the installer which catches behind a rib of the molding directed parallel to said part. The screws are supplied separately. This requires relatively much screwing from the installer, often in bad conditions, and the screws may come off and get lost due to vibrations.

The invention also aims a hinge which remedies said disadvantages.

Thus, the invention also concerns a hinge comprising two hinge parts connected to one another by a hinge pin, whereby at least one of the hinge parts is L-shaped and comprises a first leg through which the hinge pin protrudes, and a second leg standing crosswise upon it which is fixed to a molding of a window or door, and which is characterized in that the square leg is clamped onto a rib of the molding by means of at least one screw which is screwed in a tightening piece, such that the rib is clamped between the second leg and the tightening piece, whereby the tightening piece has at least one part co-operating with a guiding surface situated in the longitudinal direction of the second leg on the back side of the second leg, and which is made such that, when the screw is screwed in sufficiently, it will work in conjunction with the guiding surface in such a manner that the tightening piece is forced to tilt, thus ending up with a side edge underneath the rib.

Preferably, the part of the tightening piece working in conjunction with the guiding surface is a guide rib directed in the longitudinal direction of the molding, while the guiding surface forms the wall of a groove in the back side of the second leg, such that when the screw is screwed in sufficiently, the guide rib will penetrate in the groove, thus forcing the tightening piece to tilt.

The invention also concerns a hinge part for the above-described hinge, which hinge part is L-shaped and comprises a first leg with an opening for a hinge pin and a second leg standing crosswise upon it.

This hinge part is characterized in that at least one screw protrudes through the second, square leg, screwed in a tightening piece, whereby this screw is tilted in relation to the second leg and is held in this position by means of a bending edge or detachable edge standing on the tightening piece and sticking in a groove which is provided in the above-mentioned leg on the backside, on the side of the screw turned away from the fist leg, while, on the side of this first leg, the back side of the second leg has a guiding surface with which a part of the tightening piece situated next to a side edge co-operates, such that when the screw is screwed on further, the edge will bend and the tightening piece will tilt and will be moved with its side edge to the first leg.

BRIEF DESCRIPTION OF THE DRAWINGS

In order to better explain the characteristics of the invention, the following preferred embodiments of a hinge and a hinge part according to the invention are described as an example only without being limitative in any way, with reference to the accompanying drawings, in which:

FIG. 3 represents a view in perspective of a bush of the hinge from FIGS. 1 and 2;

DESCRIPTION OF THE PREFERRED EMBODIMENT

Figure 1:
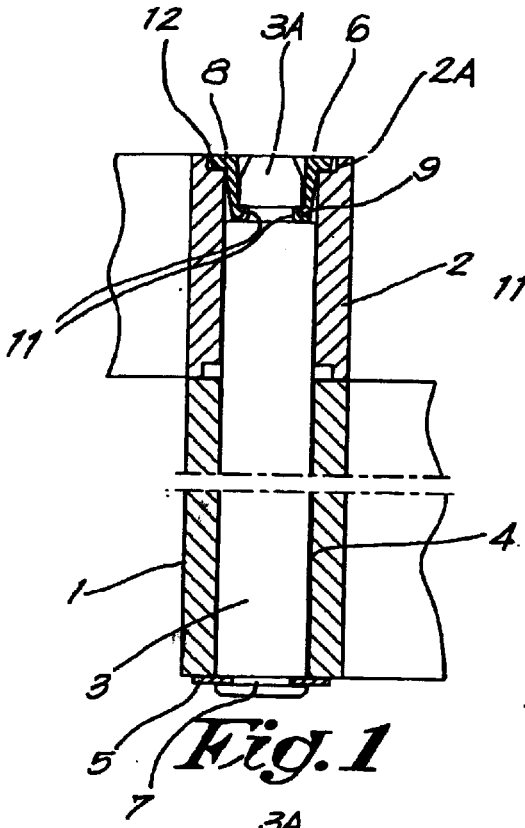
FIG. 1 represents an axial section of a hinge according to the invention.
Figure 2:
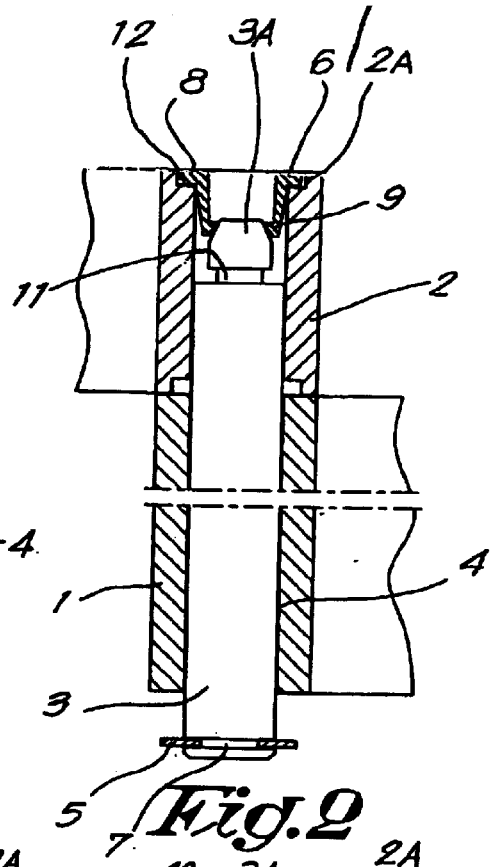
FIG. 2 represents a section analogous to that of FIG. 1, but with reference to a condition while the hinge is being composed.

The hinge represented in FIGS. 1 and 2 mainly consists of two hinge parts 1 and 2, namely a frame part 1 designed to be fixed to the frame of a window, and a leaf part 2 designed to be fixed to the window casement, as well as a hinge pin 3.

Both hinge parts 1 and 2 comprise a tubular part through which the opening 4 for the hinge pin 3 extends.

This hinge part 3 is fixed in relation to the hinge parts 1 and 2 by means of a clamping ring 5 on one far end and by a springy bush 6 on the other far end.

The clamping ring 5 snaps in a groove 7 and forms a stop which cannot go through the opening 4. It can be replaced by another stop, for example a collar or thickening of the hinge pin 3 itself.

The springy bush 6 has a collar 8 directed towards the outside on one far end, and a collar 9 directed towards the inside on its other far end.

The latter collar 9 is beveled on the inside, such that the collar decreases in height towards the far end. Between the collars 8 and 9, the bush is slightly conical, especially on the outside.

The bush 6 is springy as it has been made of elastic material, namely plastic, for example polyamide, and it is interrupted by a groove or interruption 10 over its entire height, as is clearly visible in FIG. 3. The bush 6 thus forms an interrupted ring.

The springy bush 6 sticks in the opening 4 of the leaf part 2 and surrounds a far end 3A of the hinge pin 3 therein having a smaller diameter.

Against the remainder of the hinge pin 3 is provided the far end 3A of a groove 11 in which sticks the collar 9 of the bush 6. The far end 3A is beveled at the end.

The collar 8 of the bush 6 connects onto an edge 2A of the leaf part 2 situated around the opening 4, and it is countersunk in a recess 12 in this edge 2A.

The hinge pin can be quickly fixed as follows:

The leaf part 2 is placed on the frame part 1 of the hinge, and the hinge pin 3 upon which the clamping ring 5 has already been provided, is put via the frame part 1 through the openings 4 into the hinge parts 1 and 2.

As represented in FIG. 2, before the hinge pin 3 is pushed in completely, the bush 6 is placed in the opening 4 of the leaf part 2, with the collar 8 on the edge of this leaf part 2, after which the hinge pin 3 is snapped in the bush 6 with force with its far end 3A.

The lower end of the bush 6 is pushed open in a springy manner by the beveled end of the hinge pin 3. The inwardly directed collar 9 slides over the far end 3A until it penetrates in the groove 11 as represented in FIG. 1, and thus quickly blocks the hinge pin 3 from an axial viewpoint.

It is also possible to first push in the hinge pin 3 entirely and to apply the bush 6 with force over the far end 3A only afterwards.

Naturally, there must be sufficient room between the far end 3A and the wall of the opening 4 in the leaf part 2 to be able to move the bush 6 with the collar 9 along this far end 3A, such that the collar 9 can reach the groove 11.

In principle, the bush 6 can also be situated in the frame part 1 instead of in the leaf part 1. The clamping ring 5 or another stop must then connect to the leaf part 1.

Figure 4:
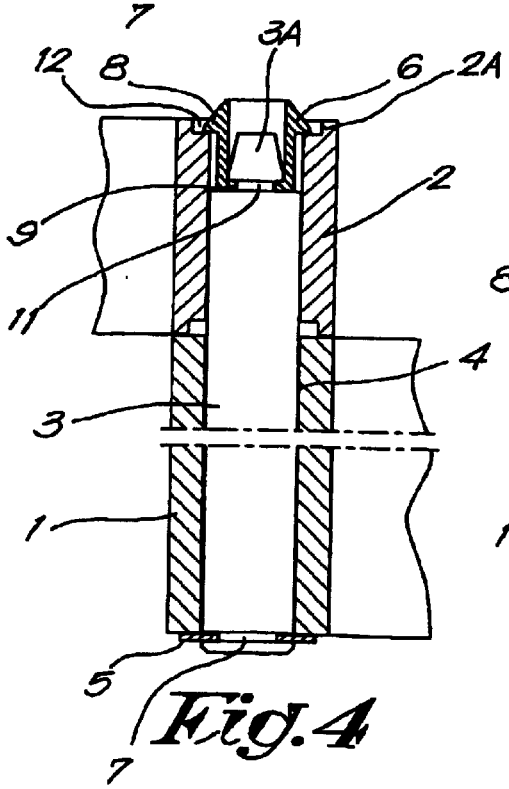
FIG. 4 represents an axial section analogous to that in FIG. 1, but with reference to another embodiment of the hinge.
Figure 5:
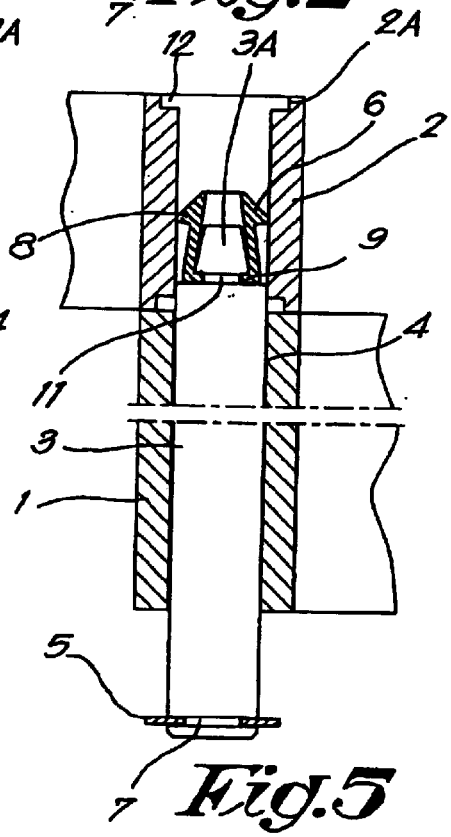
FIG. 5 represents a section analogous to that of FIG. 4, but with reference to a condition while the hinge is being composed.
Figure 5:
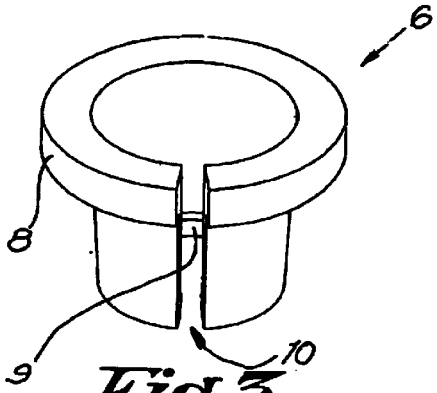

The embodiment of the hinge represented in FIGS. 4 and 5 differs from the above-described embodiment in that the shape of the bush 6 has been altered, whereby the now inwardly directed collar 9 is not beveled, but the outwardly directed collar 8 is.

Further, the bush 6 in the non-altered condition is not conical, but the diameter of the far end 3A of the hinge pin 3 will gradually diminish as of the groove 11 up to the far end.

Due to the altered form of the bush 6, also the fixing of the hinge pin 3 will be slightly different, namely in that the bush 6 is first snapped over the far end 3A of the hinge pin 3.

Then, the hinge pin 3 is pushed in the opening 4 of the frame part 1 with the bush 6 provided upon it, whereby the far end of the bush 6 with the outwardly directed collar 8 is pushed to in a springy manner, and the bush 6 can pass through the openings 4. As represented in FIG. 4, the bush 6 is pushed through the openings 4 until the collar 8 ends up past the upper edge of the leaf part 2, and the bush 6 bursts open in a springy manner, such that the collar is situated against this edge, in the recess 12, as represented in FIG. 5.

In both embodiments, the bush 6 must not necessarily have collars 8 and 9 as protrusions. On each far end of the bush can for example be provided inwardly and outwardly directed teeth over the perimeter. In the latter case, the bush 6 must not necessarily have an interruption over its height. The bush 6 may have springy strips on one or on both far ends upon which said teeth are standing.

Figure 6:
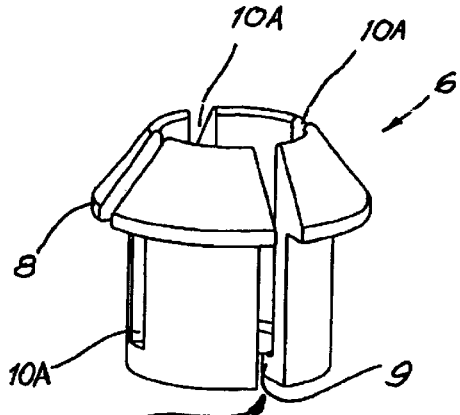
FIG. 6 represents a view in perspective of a bush analogous to that of FIG. 3, but with reference to another embodiment of this bush.

FIG. 6 represents such a bush 6 which is not only provided with an interruption 10 over its entire height, but also with some grooves 10A. These grooves 10A do not extend over the entire height, and among others not on the inwardly directed collar 9. They do interrupt the other far end of the bush 6, such that the outwardly directed collar 8 is replaced by teeth 8A standing on the springy strips separated by the interruption 10 and the grooves 10A. This far end with the outwardly directed protrusions can be more easily transformed by the grooves 10A.

The installer not only wants the fixing of the hinge pin 3, but also the fixing of the frame part 1 of the hinge to be done quickly.

Figure 7:
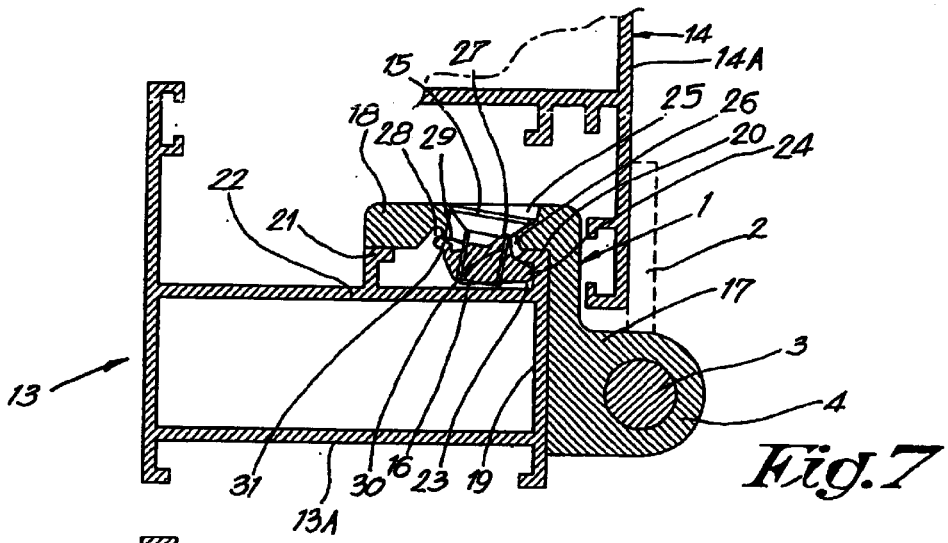
FIG. 7 represents a cross section of a molding of a window upon which the frame part of a hinge according to the invention has been fixed.

FIG. 7 represents the hinge comprising two hinge parts, namely a frame part 1 and a leaf part 2, connected by a hinge pin 3, and which is mounted on a window with a fixed frame 13 and a leaf 14.

The leaf part 2 is fixed to a molding 14A of the leaf 14 in a known manner which is not represented.

The frame part 1 is L-shaped and clamped onto a molding 13A of the frame 13 by means of screws 15, usually two or three, and a tightening piece 16.

The frame part 1 has a first leg 17 through which the hinge pin 3 extends and which lies against the flank 19 of a molding 13A, and a second leg 18 standing crosswise upon it, situated on a rib 20 standing on the edge of the flank 19, and a standing edge 21 standing on the core 22 of the molding 13A.

Between the rib 20 and the core 22 is formed a groove 23 in which the tightening part 16 sticks with one side edge 24.

Figure 8:
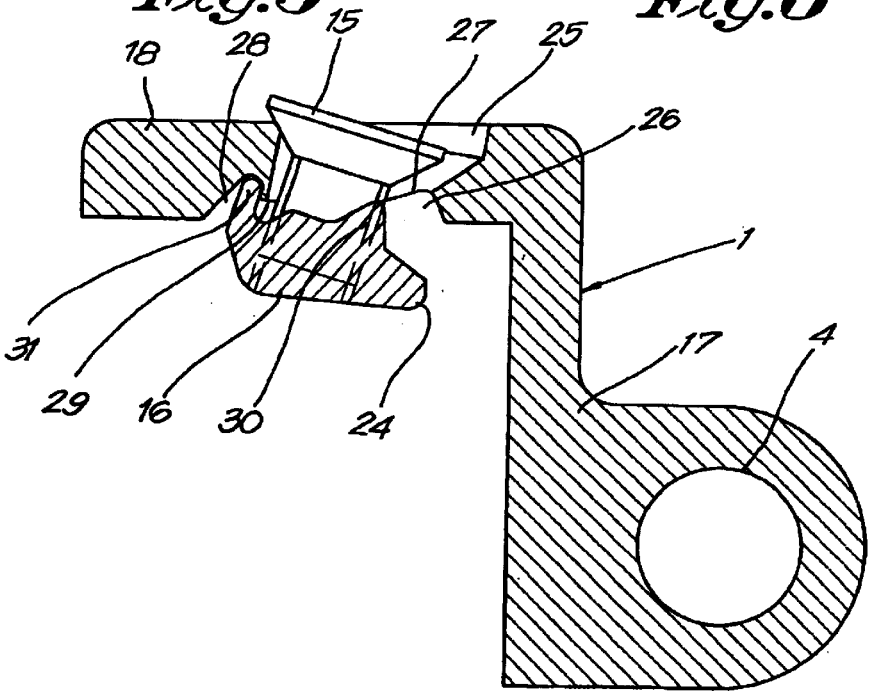
FIG. 8 represents a cross section of the frame part from FIG. 7 before it has been fixed.
Figure 9:
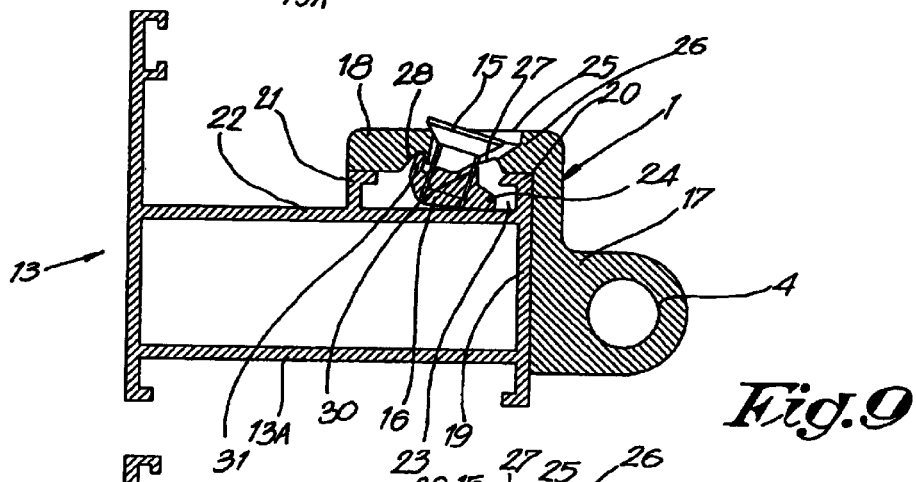
FIGS. 9 and 10 represent sections analogous to those of FIG. 7, but with reference to different stages during the fixing.

As represented in FIGS. 8 and 9, each screw 15 has already been screwed in the tightening piece 16 and has been clamped on the second leg 18 of the hinge with the latter, even before the hinge is fixed. The screws 15 and the tightening piece 16 are thus supplied on the hinge.

The tightening piece 16 has such a shape that, when the screws 15 are screwed in further, these screws 15 and the tightening piece 16 start tilting into the position as represented in FIG. 7.

The hole 25 for a screw 15 in the leg 18 is large enough to allow for such a tilting.

In order to allow for such tilting, said leg 18 has a groove 26 on its back side which crosses the holes 15 and is parallel to the longitudinal direction of the legs 17 and 18 of the molding 13A and of the rib 20, and is confined by an inclined guiding surface 27 on the side of the middle of the holes 25.

On the other side of the holes 25, a groove 28 is provided in the back side of the leg 18 which is parallel to the groove 26. Next to this groove 28, on the side of the hole 25, the back side of the leg 18 forms a guiding surface 29. The tightening piece 16 has a guide rib 30 on the side of the side edge 23, the section of which coincides more or less with the above-mentioned groove 26 in the leg 18.

On the other side, this tightening piece 16 has a bending edge 31.

When the frame part 1 of the hinge is put in place, the screws 15 and the tightening piece 16 have already been provided, and the tightening piece 16 is being held in place by the bending edge 31 and the screws, 15, as is represented in FIG. 8 before, and in FIG. 9 after the frame part 1 has been provided on the molding 13A.

For, the bending edge 31 sticks in the groove 28 of the leg 18 and stands in relation to the rest of the tightening piece 16, as is represented in FIG. 8. The guide rib 30 is pulled against the back side of the leg 18 by the rather slantingly directed screw 15 next to the groove 26.

In the above-mentioned position, the screw 15 is directed so slantingly that the leg 18 can be placed on the molding 13A with the screw 15 and the tightening piece 16 provided upon it. The side edge 24 is hereby situated outside the groove 23, as can be seen in FIG. 8.

Figure 10:
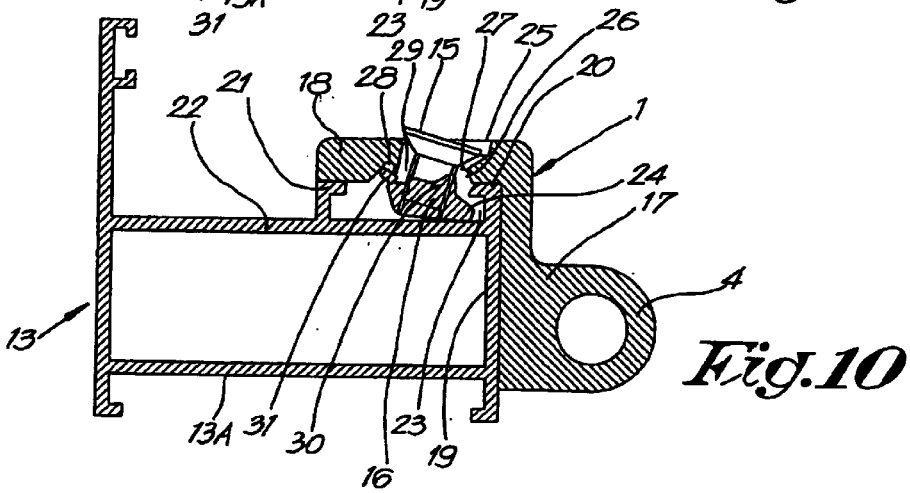

When, after the frame part 1 has been put in place, the screws 15 are subsequently screwed in further, the bending edge 31 will bend and possibly even break off. The guide 30 rib 30 will penetrate into the groove 26 and, thanks to the cooperation of this guide rib 30 with the guiding surface 29 of the groove 26, the tightening piece 16 will tilt and thereby move towards the groove 23, as is represented in FIG. 10. This tightening piece 16 is hereby also guided next to the groove 28 in the leg 18 by the guiding surface 29.

During said tilting, the side edge 24 of the tightening piece 16 will penetrate inside, the groove 23, and by further tightening the screws 15, the rib 20 is clamped between the leg 18 and the tightening piece 16, as is represented in FIG. 7. The leg 18 and thus the frame part 1 is fixed in relation to the molding 13A.

Thus, the installer can fix the frame part 1 very quickly, since the screws 15 have already been screwed in to a large extent by the manufacturer, who has the required tools to do this in a fast manner.

It is clear that the hinge pin 3 can also be fixed in the hinge according to FIGS. 7 to 9 in other manners than with a springy bush 6. In some windows, the hinge pin can be moved in the hinge parts by means of a system of rods.

The invention is by no means limited to the above-described embodiments represented in the accompanying drawings; on the contrary, such a hinge or hinge part can be made in all sorts of variants while still remaining within the scope of the invention.

What is claimed is:

1. Hinge and a molding of a door or window, comprising two hinge parts connected to one another by a hinge pin, at least one of the hinge parts being L-shaped and comprising a first leg through which the hinge pin protrudes, and a second leg standing crosswise upon the first leg and against a molding of a window or door, wherein the second leg is clamped onto a rib of the molding by means of at least one screw which is screwed in a tightening piece, such that the rib is clamped between the second leg and the tightening piece, the tightening piece having at least one part co-operating with a guiding surface of the second leg which is situated along the longitudinal direction of the molding and configured such that, when the screw is screwed into the tightening piece, the screw cooperates with the guiding surface in a manner that the tightening piece is forced to tilt whereby a side edge of the tightening piece is urged underneath the rib;

wherein the part of the tightening piece working in conjunction with the guiding surface is a guide rib directed in the longitudinal direction of the molding, the guiding surface forming the wall of a groove in the back side of the second leg, such that when the screw is screwed into the tightening piece, the guide rib will penetrate into the groove, thus forcing the tightening piece to tilt.

2. The hinge according to claim 1, wherein the second leg has a groove arranged to receive a bending or detachable edge of the tightening piece on a side thereof opposite the guiding surface.

3. A hinge part for the hinge according to claim 1, the hinge part being L-shaped and comprising a first leg with an opening for a hinge pin, and a second leg standing upon the first leg in a crosswise orientation, wherein at least one screw into a tightening piece, the at least one screw being held in position by a bendable or detachable edge extending from the tightening piece and into a groove in the back side of the second leg located on a side of the screw cooperating with the tightening piece such that, when the screw is screwed into the tightening piece, the bendable or detachable edge will bend and the tightening piece will tilt and be urged against the first leg.

4. The hinge part according to claim 3, wherein on the side of the groove for the bending edge or detachable edge, the back side of the second leg has a guiding surface with which a part of the tightening piece cooperates during said tilting.

5. The hinge part according to claim 3, wherein a plurality of screws are screwed into the tightening piece.

6. A hinge system including the hinge part according to claim 3, and a molding of a door or window, wherein the hinge is placed against a flange of the molding with the first leg, and the second leg connects to a rib standing on the flange, the rib forming a groove together with a core of the molding whereat the tightening piece is maintained against the second leg, whereby said tightening piece is situated entirely outside said groove.

7. A hinge system including the hinge part according to claim 3 and a molding, wherein the hinge is arranged on a rib of the molding, such that the bendable or detachable edge is bent broken off, and the screw and the tightening piece are tilted in relation to one another such that the rib is clamped between the back side of the second leg and a side edge of the tightening piece.

* * * * *